US010167109B2

(12) United States Patent
Warner et al.

(10) Patent No.: US 10,167,109 B2
(45) Date of Patent: Jan. 1, 2019

(54) SAFETY CONTAINER

(71) Applicant: AssurPack LLC, Greenwood Village, CO (US)

(72) Inventors: Nancy Warner, Greenwood Village, CO (US); Jeremiah Buck, Wheat Ridge, CO (US)

(73) Assignee: Assurpack, LLC, Greenwood Village, CO (US)

( * ) Notice: Subject to any disclaimer, the term of this patent is extended or adjusted under 35 U.S.C. 154(b) by 69 days.

(21) Appl. No.: 15/401,535

(22) Filed: Jan. 9, 2017

(65) Prior Publication Data

US 2017/0137167 A1 May 18, 2017

Related U.S. Application Data

(60) Provisional application No. 62/329,775, filed on Apr. 29, 2016.

(30) Foreign Application Priority Data

Jun. 3, 2016 (CN) ..... 2016 2 05368230 U

(51) Int. Cl.

| | |
|---|---|
| ***B65D 5/38*** | (2006.01) |
| ***B65D 6/06*** | (2006.01) |
| ***A61J 1/03*** | (2006.01) |
| ***B65D 43/16*** | (2006.01) |
| ***B65D 43/22*** | (2006.01) |

(52) U.S. Cl.

CPC ..... *B65D 11/12* (2013.01); *A61J 1/03* (2013.01); *B65D 43/162* (2013.01); *B65D 43/22* (2013.01); *B65D 2215/02* (2013.01)

(58) Field of Classification Search

CPC ..... B65D 2583/0468; B65D 5/38; B65D 2583/0454; B65D 5/728; B65D 11/12

USPC ..... 220/23.87, 23.23, 254.5, 246, 838

See application file for complete search history.

(56) References Cited

U.S. PATENT DOCUMENTS

| | | | |
|---|---|---|---|
| 3,888,350 | A | 6/1975 | Horvath |
| 4,126,224 | A | 11/1978 | Laauwe |
| 4,364,488 | A | 12/1982 | Anjou |

(Continued)

FOREIGN PATENT DOCUMENTS

CN 205671697 U 11/2016

OTHER PUBLICATIONS http://www.dhgate.com/product/nonstick-wax-containers-silicone-box-silicon/217393839.html.

http://cooljarz.com/products/2-dram-silicone-lined-concentrate-child-resistant-jars.

*Primary Examiner* — Shawn M Braden

(74) *Attorney, Agent, or Firm* — John H. Choi & Associates LLC

(57) ABSTRACT

A safety container having a liner disposed within an outer container. The liner includes a liner box removably coupled to a liner lid. The liner box has a liner floor with upwardly extending liner walls. In a first closed state the liner lid is positioned such that the liner lid engages the liner walls. The liner lid is removable from the liner walls in a first open state. The outer container box is slidingly coupled to the outer container lid through openings at opposing ends of the outer container lid. In a second closed state the outer container box and liner are enclosed by the outer container lid. The outer container box is slidably removed at least partially from the outer container lid to a second open state while the liner is configured to the first open state.

19 Claims, 9 Drawing Sheets

(56) References Cited

U.S. PATENT DOCUMENTS

| | | | | |
|---|---|---|---|---|
| 4,561,544 | A | 12/1985 | Reeve | |
| 4,844,284 | A | 7/1989 | Drozd | |
| 5,082,137 | A | 1/1992 | Weinstein | |
| 7,721,660 | B1 * | 5/2010 | Davis | E05G 7/008 109/19 |
| 8,091,709 | B2 * | 1/2012 | Gnepper | B65D 11/12 206/37 |
| 8,356,712 | B2 * | 1/2013 | Piazza, Jr. | A45C 9/00 108/14 |
| 9,815,584 | B2 * | 11/2017 | Schwester | B65D 5/38 |
| 2007/0062964 | A1 * | 3/2007 | Kampf | B65D 43/162 220/835 |
| 2008/0060975 | A1 * | 3/2008 | Young | B65D 5/38 206/745 |
| 2009/0152134 | A1 | 6/2009 | Katsis | |

* cited by examiner

SAFETY CONTAINER

CROSS-REFERENCE TO RELATED APPLICATION

This application claims priority to U.S. Provisional Application No. 62/329,775, filed on Apr. 29, 2016.

FIELD

The present disclosure relates to the field of containers, in particular, to a portable container with an internal enclosure.

BACKGROUND

The design of portable containers have evolved over the years such that many varieties of containers are manufactured and sold based on particular applications. One of those applications is for medicine (e.g., tablets and capsules) for a user to easily carry small doses of medication for use while traveling or while away from home.

With storage of medicine, however, safety is a priority. Especially important is child safety. For this reason, child resistant portable medicine containers have been developed.

One such container is disclosed in U.S. Pat. No. 3,888,350 (the "'350 Patent"), which is incorporated by reference. That container, shown in FIG. 3 of the '350 Patent, includes a substantially rigid lower box 6 with an open top coupled to a substantially rigid upper lid 4 with an open bottom and an open end. The lower box 6 and upper lid 4 are slidably engaged for opening for access and closing to a locked state.

As shown in FIG. 5 of the '350 Patent, the upper lid 4 includes a slit 7 on a back wall and a first catch 15 extending from a bottom surface of the upper lid 4 adjacent to the back wall. The first catch 15 is positioned away from the back wall at a distance substantially similar to the thickness of a back wall of the lower box 6. The upper lid 4 and the lower box 6 are locked against each other when the back wall of the lower box 6 is positioned between the first catch 15 and the back wall of the upper lid 7. The upper lid 4 includes a sloped channel 11a, 12a adjoining each side wall 14 and bottom surface. A pair of second catches 17 are positioned near the open end adjacent the sloped channels 11a, 12a.

As shown in FIG. 4 of the '350 Patent, the lower box 6 includes recesses 22, 23 extending along an inner top surface of each side wall. A pair of flanges 18, 19 extends outward from each of the side walls at an angle equal to the angle of the sloped channels 11a, 12a.

In operation, as shown in FIGS. 6-8 of the '350 Patent, the upper lid 4 slides on the lower box 6 by engagement of respective sloped channels 11a, 12a and flanges 18, 19, as well as respective recesses 22, 23 and second catches 17. As mentioned above, the upper lid 4 and the lower box 6 are locked to each other when the lower box 6 back wall is secured between the first catch 15 and the upper lid 4 back wall. Applying an inward force to each side of the upper lid 4 at the back wall causes the slit 7 to contract, causing the upper lid 4 to bow while moving the first catch 15 downward. Simultaneously, the user pulls the lower box 6 away from the upper lid 4 in a direction opposite the slit 7. The combined effect releases the first catch 15 from the lower box 6 back wall, allowing the upper lid 4 to slide open along the lower box 6.

The configuration of the above mentioned container is child resistant due to the required force to release the upper lid 4 from the lower box 6 in the locked state. However, the container poses several problems.

For example, the upper lid 4 cannot be completely removed from the lower box 6 due to the continuous engagement of the second catches 17 with the respective recesses 22, 23. As a result, it may be difficult to access product remaining under the upper lid 4.

Another problem is that the container is not sound proof. The container consists of a substantially rigid plastic, such as polyethylene and polypropylene. Thus, noise is generated when the medicine or other product within the container is displaced during transport.

Yet another problem exists in that other materials cannot be properly stored and transported within the container. For example, materials having odor such as raw tobacco products, non-traditional alternative medicines, and alternative nicotine products such as dry herb, wax or oil vaporizer products in solid, liquid and semi-liquid form, cannot be stored within the container because of leakage and odor concerns.

To solve this problem, containers for these applications have been developed and are sold. These containers are sold, for example, at http://www.dhgate.com/product/nonstick-wax-containers-silicone-box-silicon/217393839.html, which is incorporated by reference. However, these containers are not child resistant. In addition, because of the shape and size of the container, it is difficult to conceal when it is carried in one's pocket as a bulge is formed thereto.

Thus, a similar cylindrical container was developed to incorporate child resistance, shown, for example, at http://cooljarz.com/products/2-dram-silicone-lined-concentrate-child-resistant-jars. Like the prior art container discussed in the previous paragraph, this container poses the same problem in that it is difficult to conceal when carried in one's pocket. Also, manufacturing cost is increased due to the extra material required as well as more upfront costs in developing molds for threaded portions of the container. More importantly, this prior art container requires extra steps in opening and closing the container, thus, making it more time consuming for the user.

Therefore, a need exists for a child resistant container for transporting all forms of materials and products such as medicine, as well as materials with odor including liquid and semi-liquid products. A need also exists for a safety container that is easy to use and capable for an adult to open and close quickly while being child resistant.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The safety container of the present invention solves the problems of the prior art in that it provides an easy to use child resistant container that is flat and concealable. The present invention also provides a container for transporting materials such as medicine and other materials with odor including liquid and semi-liquid products. Specifically, the present invention is for a safety container having an outer container with a liner therein that is leak-proof.

An inner liner for the container can protect the container from the contents. A silicone liner can provide cushioning to protect fragile contents and sound dampening for content which may move when the container is in motion. A silicone liner can also provide a heat buffer which can protect the contents from environmental heat or protect the container and user from high-temperature content. Moreover, a silicone liner can provide a better seal for containing liquids and odors and protect the contents from the outside environment. A removable liner allows the liner to be replaced or cleaned without replacing the entire container or cleaning the container which may require special tools depending on the size of the container and special cleaning products depending on the material being cleaned.

In general, the safety container of the present invention comprises a sliding outer container and a liner having: (i) a rectangular container box with an open top; (ii) a rectangular container lid having a top portion, two opposing side walls, and a rear wall; and (iii) a rectangular liner having a liner box with an open top and a liner lid. The liner is configured to fit within the container box and to be completely enclosed when the container lid is in a locked state with the container box.

In one embodiment, the safety container comprises a liner, the liner having a liner box coupled to a liner lid by a hinge, the liner box having a liner floor with upwardly extending liner walls, the liner lid being coupled to at least one of the upwardly extending liner walls, wherein in a first closed state the liner lid is positioned such that the liner lid engages the liner walls and in a first open state the liner lid is pivotable away from the liner walls. The safety container also includes a container box slidingly coupled to a container lid, the container box having a floor with a plurality of inner container walls extending upwardly therefrom, the container lid having a top plate with a plurality of outer container walls extending downwardly therefrom, wherein the container box is slidingly coupled to the container lid such that in a second closed state the container box is enclosed by the container lid and in a second open state the container box is at least partially removed from the container lid.

In one aspect, the liner is positioned within the container box such that in the second closed state the liner is in the first closed state and enclosed within the container box and container lid, and in the second open state the liner is in the first open state. In the first open state the liner lid is pivoted away from the liner walls to a position at least parallel to the liner floor.

In another aspect, the container lid comprises a locking member extending from a lower surface of the top plate, the locking member positioned on the lower surface such that a space is formed between the locking member and an outer container wall, an inner container wall positioned within the space when in the second closed state.

In another embodiment, the safety container comprising a liner disposed within a container, the container comprising a container box slidingly coupled to a container lid, the container box having a floor with a plurality of inner container walls extending upwardly therefrom, the container lid having a top plate with a plurality of outer container walls extending downwardly therefrom, wherein the container box is slidingly coupled to the container lid; the liner having a liner box coupled to a liner lid by a hinge, the liner box having a liner floor with upwardly extending lower liner walls, the liner lid being coupled to at least one of the upwardly extending lower liner walls, wherein the liner is positioned within the container box such that the lower liner walls engage the inner container walls; wherein in a closed state the liner lid engages the lower liner walls and the container lid encloses the container box, an inner container wall being positioned within the slot; wherein in an open state the container lid is at least partially removed from the container box and the liner lid is pivotable away from the lower liner walls.

In one aspect, the container lid comprises a locking member projecting downwardly from an underside of the top plate, the locking member having an edge disposed a distance away from an outer container wall to form a slot therebetween, the locking member being tapered in decreasing thickness from the edge to an opposing end of the locking member, the opposing end having a smooth junction with the underside of the top plate.

In one embodiment, the locking member is substantially U-shaped, free ends of the U-shape having a smooth junction with the underside of the top plate, an opposite end of the U-shape forming the edge. In another embodiment, the locking member is substantially V-shaped, free ends of the V-shape having a smooth junction with the underside of the top plate, an opposite end of the V-shape forming the edge.

In another aspect, the lower liner walls comprise a first engagement member positioned along an upper end of said lower liner walls, and the liner lid comprises a second engagement member positioned on an underside of said liner lid. In one embodiment, the first engagement member includes a continuous channel formed along the upper end of the lower liner walls and the second engagement member includes a continuous projection extending from the underside of the liner lid underside, the channel and projection matching such that the projection is secured within the channel when engaged. In another embodiment, the first engagement member includes a continuous ridge formed along the upper end of the lower liner walls and the second engagement member includes upper liner walls extending downwardly from the liner lid, the upper liner walls secured within the ridge when engaged.

In yet another embodiment, the safety container of the present invention comprises a liner disposed within an outer container, the outer container comprising a drawer slidingly coupled to a cover, the drawer having a bottom member with a plurality of inner walls extending upwardly therefrom, the cover having an top member with a plurality of outer walls extending downwardly therefrom, wherein the drawer is slidingly coupled to the cover; the liner having a liner box removably coupled to a liner lid, the liner box having a liner floor with upwardly extending lower liner walls, the liner lid being coupled to at least one of the upwardly extending lower liner walls, wherein the liner is positioned within the container box such that the lower liner walls engage the drawer inner walls; wherein in a closed state the liner lid engages the lower liner walls and the outer container cover encloses the outer container drawer; wherein in an open state the outer container cover is at least partially removed from the outer container drawer and the liner lid is removable from the liner box lower liner walls.

In one embodiment, the liner box is hingedly coupled to the liner lid. In another embodiment, a continuous channel is formed along an upper end of the lower liner walls and a continuous projection extends from the liner lid underside, the channel and projection matching such that the projection is secured within the channel when engaged.

The foregoing has outlined rather broadly the more pertinent and important features of the present invention so that the detailed description of the invention that follows may be better understood and so that the present contribution to the art can be more fully appreciated.

Additional features of the invention will be described hereinafter which will form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention.

BRIEF DESCRIPTION OF DRAWINGS

The above and other objects, features and advantages of the present disclosure will be more apparent from the following detailed description taken in conjunction with the accompanying drawings, in which.

Figure 1:
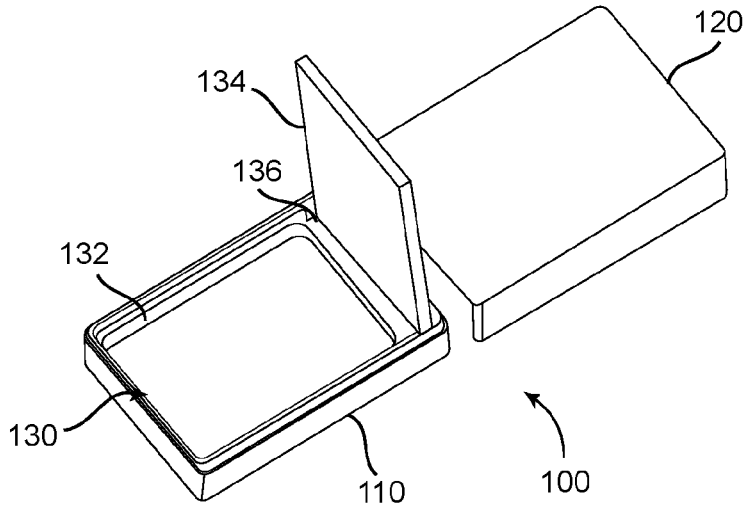
FIG. 1 is a perspective view of an embodiment of a safety container of the present invention showing a container and liner or insert of the present invention in a fully open position.

To facilitate an understanding of the embodiments, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION

Exemplary embodiments are described herein to provide a detailed description of the present disclosure. Variations of these embodiments will be apparent to those of skill in the art. Moreover, certain terminology is used in the following description for convenience only and is not limiting. For example, the words "top" and "bottom," or "upper" and "lower" designate directions in the drawings to which reference is made. The word "a" is defined to mean "at least one." The terminology includes the words above specifically mentioned, derivatives thereof, and words of similar import.

Figure 2:
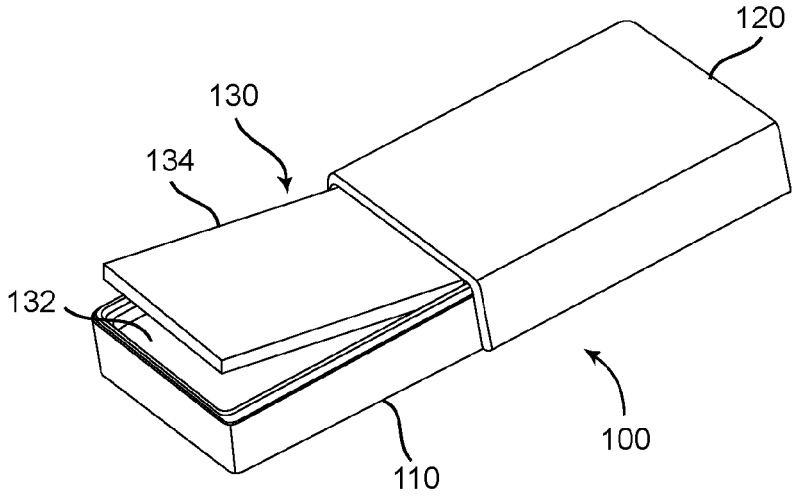
FIG. 2 is a perspective view of the container and insert of FIG. 1 in a partially closed position.
Figure 3:
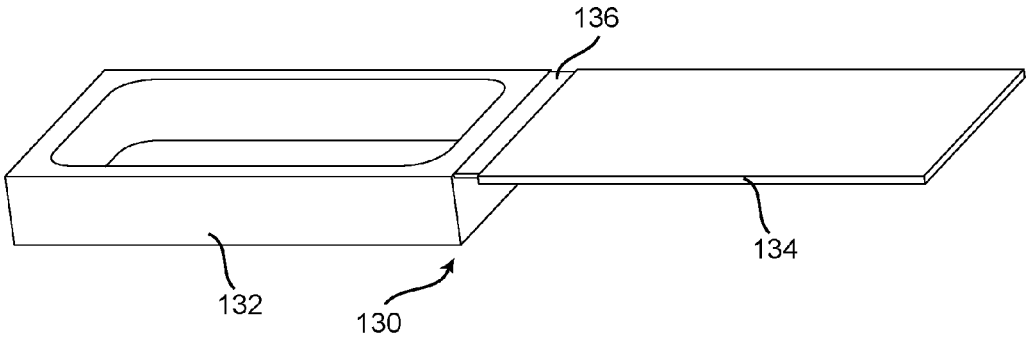
FIG. 3 is a perspective view of the insert of FIG. 1 in a fully open position.

Referring to FIGS. 1-3, is a perspective view of an embodiment of the present invention. In this embodiment, a sliding container 100 similar to or identical to the sliding container of the '350 Patent, as described above, is provided. The sliding container 100 includes a rectangular outer container box or drawer 110 with an open top and a rectangular outer container lid or cover 120 having a top portion, two opposing side walls and a rear wall. Each of the box 110 and lid 120 are constructed of a rigid or semi-rigid material such as plastic. In this embodiment, the box 110 and lid 120 are constructed with polystyrene. As described above, the rectangular container box 110 and the rectangular container lid 120 are lockable and slide with respect to each other. In this embodiment, the sliding container 100 is substantially the same as the container in the '350 Patent except that the container 100 is configured without the second catches 17 so that the box 110 and lid 120 are completely separable. With this type of configuration, a user is able to access stored product regardless of what portion of the box 110 the product is located.

Figure 4:
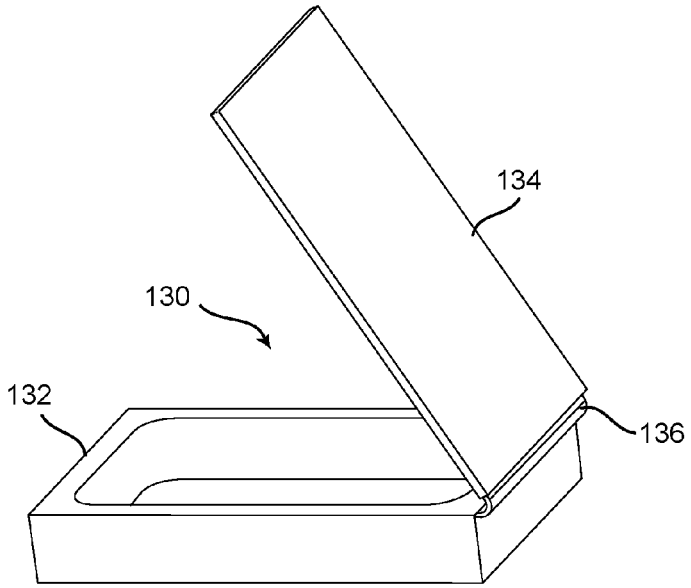
FIG. 4 is a perspective view of the insert of FIG. 1 in a partially closed position.
Figure 5:
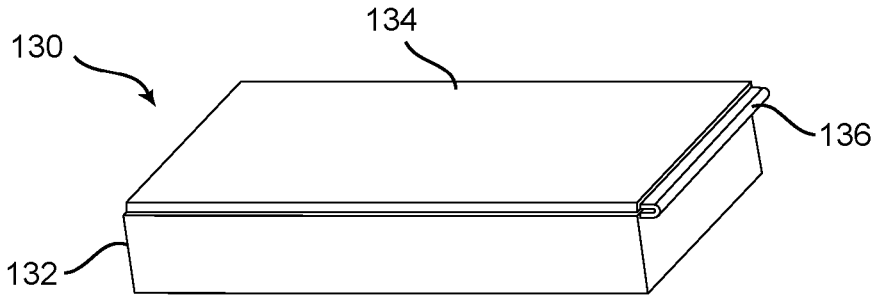
FIG. 5 is a perspective view of the insert of FIG. 1 in a fully closed position.

Referring to FIGS. 3-5, within the sliding container 100 is a removable liner or insert 130. The liner 130 includes a liner box 132 and a liner lid 134 coupled together with a hinge 136. The liner 130 is made of a relatively soft, non-porous material, including but not limited to silicone and other materials coated with silicone. Silicone provides a non-stick surface and is ideal for liquid or semi-liquid products to be stored. Also, the soft material provides dampening or absorbs sound when a hard product is stored within the liner 130.

Still referring to FIGS. 3-5, the hinge 136 could be a separate assembled part or could be constructed integral to the box 132 and lid 134, for example, formed by molding the box 132 and lid 134 together. Referring to FIGS. 1 and 2, the liner 130 is sized such that it fits snugly inside the container box 110. Furthermore, the liner lid 134 is positioned such that the top surface of the container box 110 is aligned with the top surface of the liner lid 134.

In one embodiment, the part of the hinge 136 facing the inside of the liner 130 is reinforced with additional silicone such that the liner lid 134 is normally open, or open in a rested state, as shown in FIG. 3. With this configuration, a user can open and close the liner 130 without engaging the lid 134. That is, when the user separates the container box 110 from the container lid 120, the liner lid 134 is automatically opened. When the user inserts the container box 110 having the liner 130 into the container lid 120, the liner lid 134 engages the bottom of the container lid 120 and the liner 130 is closed as the container box 110 slides into the container lid 120.

In another embodiment, the liner 130 is formed integral to the container box 110, thereby reducing manufacturing costs. Also, the liner 130 could be constructed of hard plastic while a soft material such as plastic foam or silicone is attached to the inner surface of the liner box 132 and a bottom surface of the liner lid 134 to provide dampening or sound absorption of any hard materials within that are displaced during transport.

Figure 6:
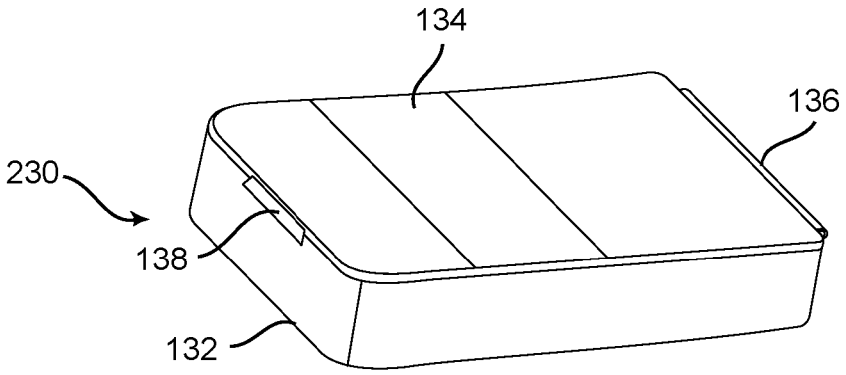
FIG. 6 is a perspective view of another embodiment an insert or liner of the present invention in a fully closed position.

FIG. 6 is a perspective view of another embodiment of a liner 230 of the present invention. In this embodiment, the liner 230 is substantially similar to the liner 130 described above except that it is provided with a fingernail groove 138 for opening the liner 230. That is, the top edge of the liner box 132 of the wall opposite the hinge 136 as well as and the bottom edge of the liner lid 134 of the wall opposite the hinge 136 each contain a groove or indent to form the fingernail groove 138. The grooves or indents only partially extend through the respective walls and thus the liner 230 is completely enclosed when the liner lid 134 is closed despite the presence of the fingernail groove 138.

Figure 7:
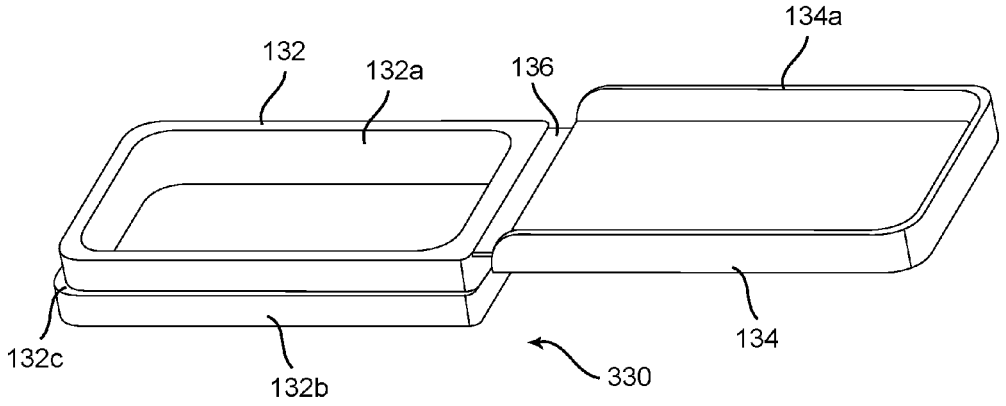
FIG. 7 is a perspective view of another embodiment of an insert or liner of the present invention in a fully open position.
Figure 8:
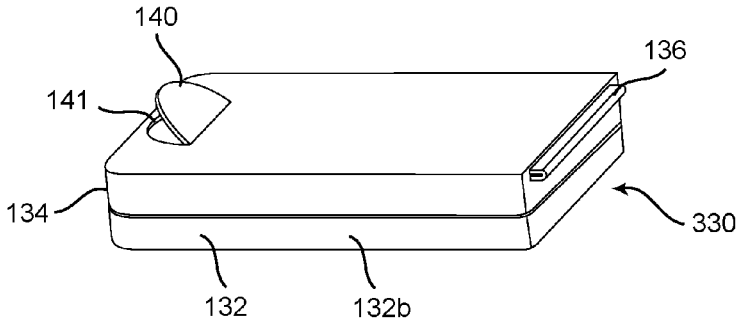
FIG. 8 is a perspective view of the insert of FIG. 7 in a fully closed position.

Another embodiment of a liner 330 of the present invention is shown in FIGS. 7 and 8. In this embodiment, the walls of the liner box 132 includes an inner portion 132*a* and an outer portion 132*b*. The inner portion 132*a* is sized slightly smaller than the outer portion 132*b* such that an intermediate surface 132*c* is formed therebetween. The liner lid 134 includes downwardly extending flanges 134*a* in which the flanges 134*a* have a thickness substantially similar to the width of the intermediate surface 132*c*. In a closed configuration, the flanges 134*a* engage the intermediate surface 132*c* to provide an enclosure. The liner 330 also includes an indent 141 and a matching flexible tab 140 at a top surface of the liner lid 134. When the container lid 120 is closed, the tab 140 folds down into the indent 141. When the container lid 120 is opened, the tab 140 returns to the upright position such that the liner lid 134 can be opened by engaging and pulling the tab 140 to separate the liner lid 134 from the liner box 132.

Figure 9:
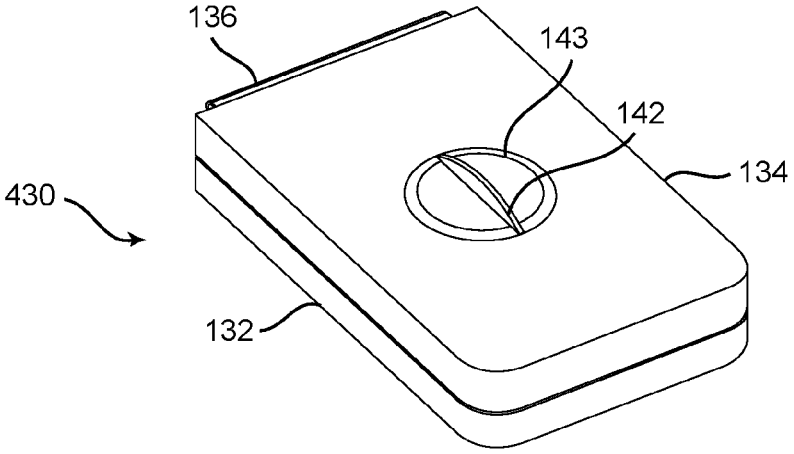
FIG. 9 is a perspective view of another embodiment of an insert or liner of the present invention in a fully closed position.

FIG. 9 is a perspective view of another embodiment of a liner 430 of the present invention. In this embodiment, the liner 430 is identical to the liner 330 shown in FIGS. 7 and 8 except that the indent 141 and tab 140 is replaced by an integral handle 142 extending from the top surface of the liner lid 134. The handle 142 is formed within an indent 143 such that a top surface of the handle 142 is co-planar to the top surface of the liner lid 134. Alternatively, the handle 142 could extend to below top surface of the liner lid 134. The liner lid 134 can be opened by using the handle 142 to separate the liner lid 134 from the liner box 132.

Figure 10:
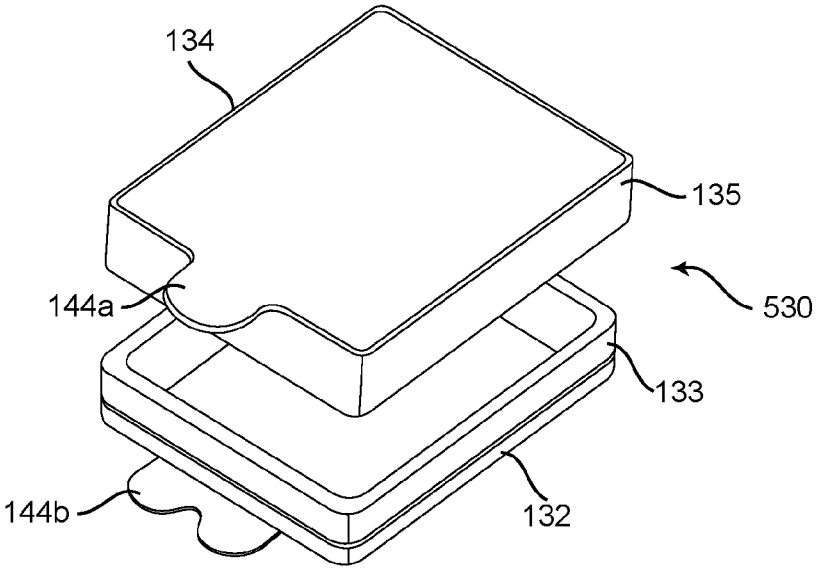
FIG. 10 is a perspective view of another embodiment of an insert or liner of the present invention in a fully open position.

FIG. 10 shows another embodiment of the liner 530 of the present invention. In this embodiment, the liner lid 134 further comprises four downwardly extending walls 135 with raised ridges (not shown) on inner sides of the wall. The liner lid 134 also includes an upper tab 144*a* extending laterally from one wall 135. The liner box 132 further comprises four upwardly extending indented walls 133 and a lower tab 144*b* extending laterally from a wall 133 corresponding to the upper tab 144*a* on the liner lid 134. The inner sides and raised ridges (not shown) of the lid walls 135 engage the outer sides of the indented liner box walls 133 in a closed configuration of the liner 530 such that the raised ridges of the liner lid walls 135 are positioned adjacent to and engage the indented liner box walls 133, providing a secure seal. The liner lid 134 can be separated from the liner box 132 by engaging and pulling the upper tab 144*a*. The liner box 132 could be removed from the container box 132 by engaging and pulling the lower tab 144*b*. It is preferred that the liner 530, including each of the tabs 144*a*, 144*b*, is constructed of silicone. This construction provides flexible tabs 144*a*, 144*b*. It is also preferred that the liner 530 be sized slightly smaller than the container box 130 so that the tabs 144*a*, 144*b* could be concealed within the container 100 when the container 100 is closed and locked, and the user could have easy access to the tabs 144*a*, 144*b* when the container 100 is opened. In the alternative, the liner 530 could be constructed with a hinge so that the liner is a one-piece construction.

Figure 11:
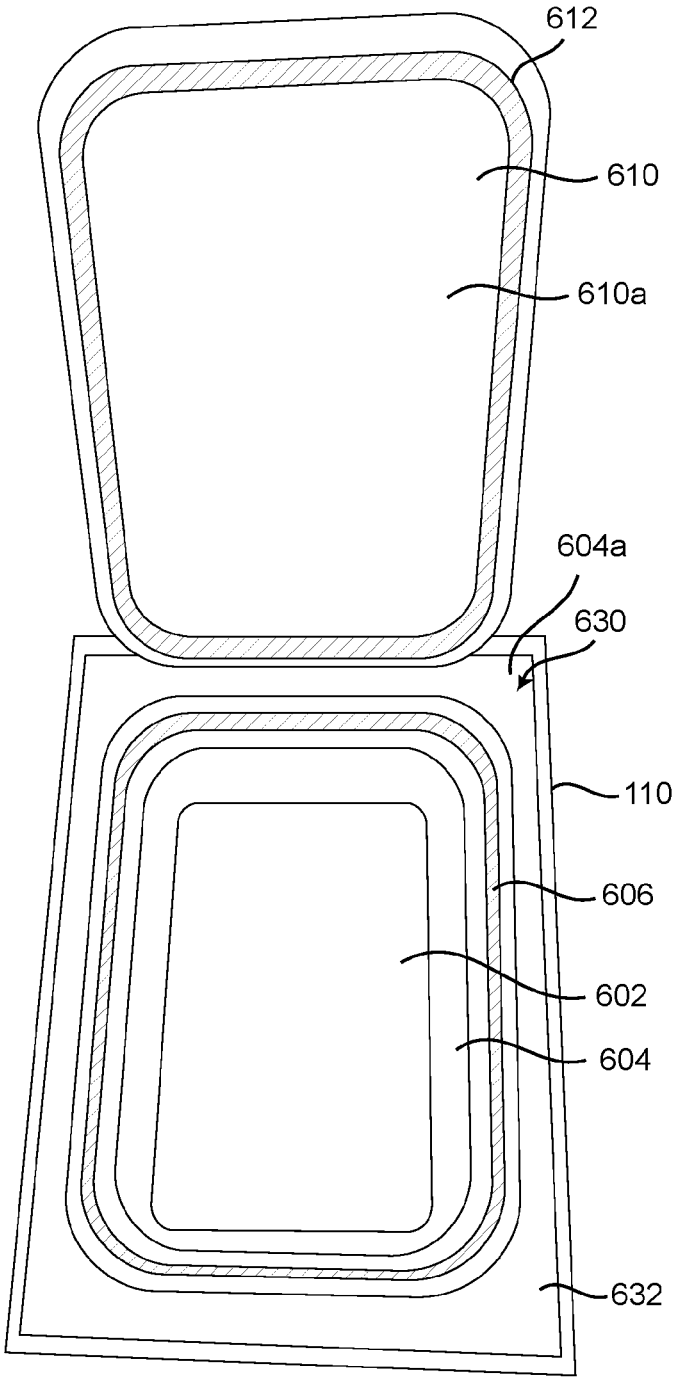
FIG. 11 is a top view of another embodiment of an insert or liner of the present invention in an open state positioned within an outer container box or drawer of the present invention.
Figure 12:
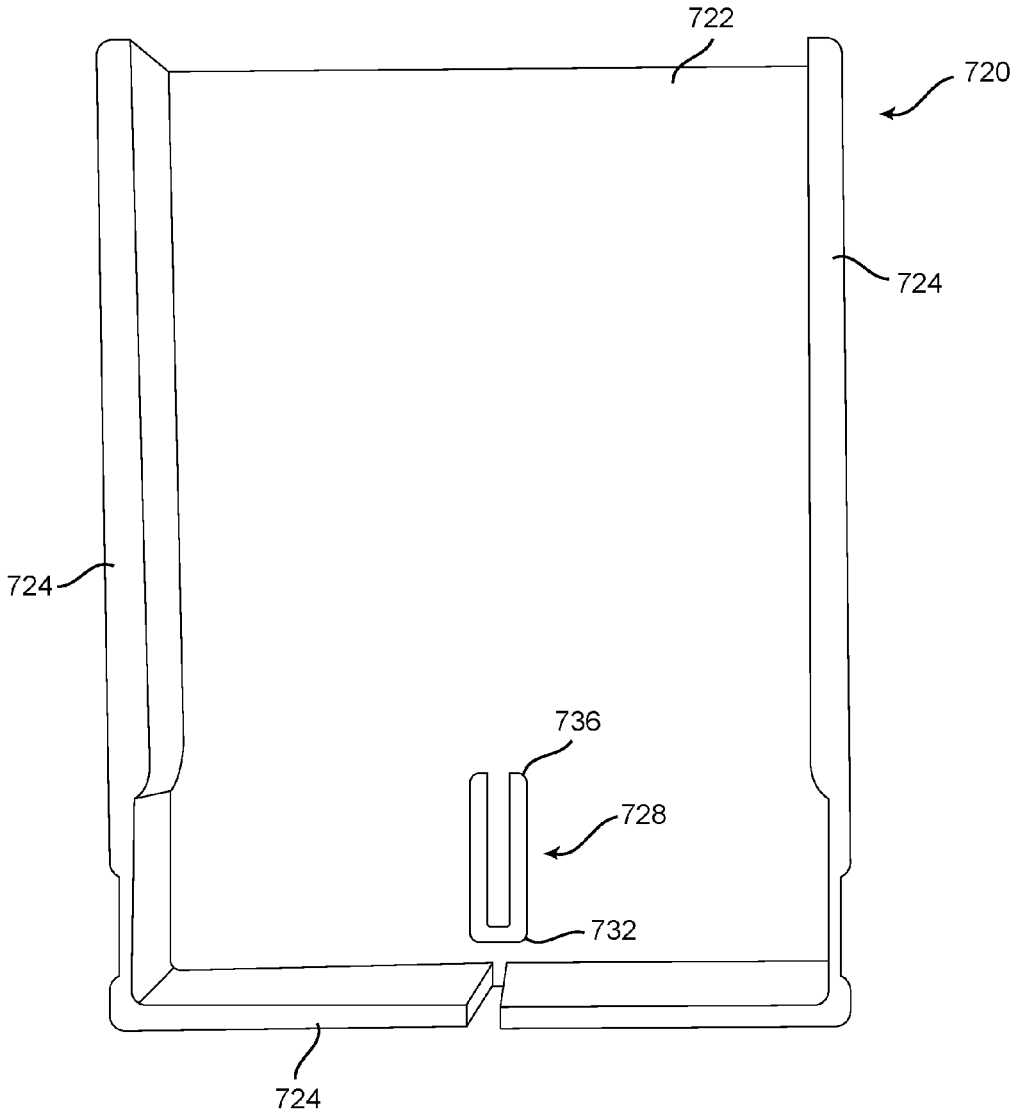
FIG. 12 is a bottom view of an embodiment of an outer container lid or cover of the present invention.

Referring to FIG. 11, another embodiment of an insert or liner 630 of the present invention is shown positioned within the outer container box 110. In this embodiment, the liner 630 includes a liner box 632 having a liner floor 602 with upwardly extending liner walls 604. A continuous channel 606 is formed along an upper end of the liner walls 604. A liner lid 610 is hingedly coupled to a rear liner wall 604*a*. A continuous projection 612 extends from the liner lid underside 610*a*. The channel 606 and projection 612 are matching such that the projection 612 is secured within the channel 606 when engaged in a first closed state (not shown). In a first open state, as shown in FIG. 11, the liner lid 610 is pivotable away from the liner walls 604. In this embodiment, the liner 630 provides an air tight and leak proof inner container while the outer container 100 provides a child proof enclosure. Thus, materials such as oils and the like could be stored and transported without concern of odors, leakage and access to children. Additionally, as described above, the hinge portion of the liner 630 where the liner lid 610 and liner box 632 are joined could be reinforced with plastic so that the liner lid 610 remains open. Alternatively, the liner box 632 and liner lid 610 could be constructed of a softer and more elastic plastic such that a tighter seal is formed between the channel 606 and projection 612.

Figure 13:
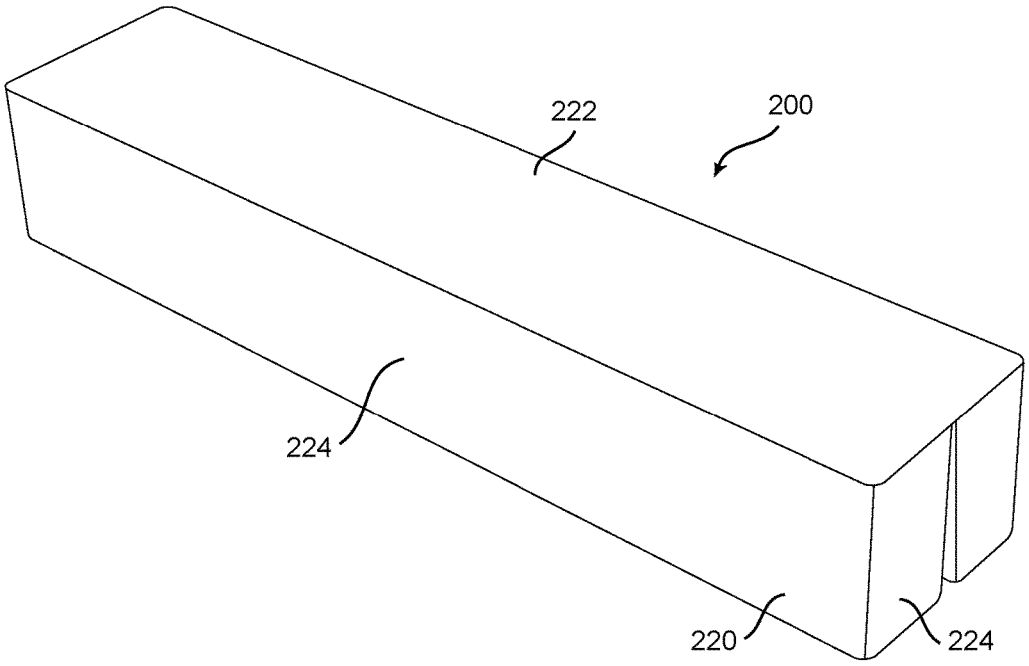
FIG. 13 is a perspective view of another embodiment of a safety container of the present invention.
Figure 14:
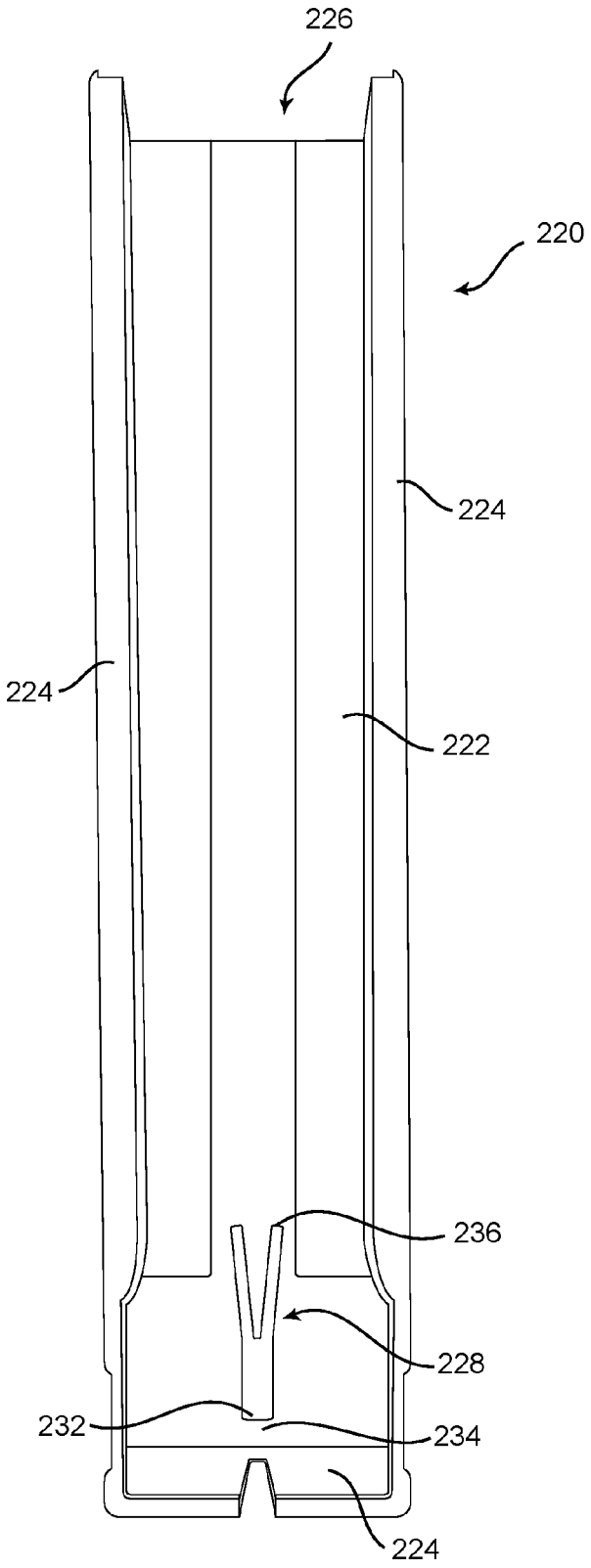
FIG. 14 is a bottom view of another embodiment of an outer container lid or cover of the present invention.

Referring to FIGS. 13 and 14, another embodiment of a safety container 200 of the present invention is shown. The safety container 200 includes an outer container drawer (not shown) removable from and slidable within an outer container cover 220. The outer container cover 220 includes a top plate 222 with three outer walls 224 extending downwardly therefrom and having an opening 226 for the outer container drawer to enter into. The configuration of the safety container 200 is similar to the safety container 100 described above with a few exceptions. First, the safety container 200 is long and narrow, specifically, 3⅜" in length×9/16" in height×11/16" in depth. Thus, the safety container 200 of this embodiment is suitable for storage and transport of oil cartridges for recreational nicotine use and the like.

Referring to FIG. 14, the outer container cover 220 includes a locking member 228 projecting downwardly from an underside of the top plate 222. The locking member 228 includes an edge 232 disposed a distance away from an outer container wall 224, forming a slot 234 therebetween. The locking member 228 is tapered in decreasing thickness from the edge 232 to an opposing end 236 of the locking member 228. The opposing end 236 includes a smooth junction with the underside of the top plate 222. In this embodiment, the locking member 228 is substantially V-shaped, free ends 236 of the V-shape having a smooth junction with the underside of the top plate 222 and an opposite end of the V-shape forming the edge 232.

In another embodiment, as shown in FIG. 13, an outer container cover 720 has a top plate 722 with outer walls 724 extending therefrom. The locking member 728 in this embodiment is substantially U-shaped, free ends 736 of the U-shape having a smooth junction with the underside of the top plate 722 and an opposite end of the U-shape forming the edge 732. With these locking member 228, 728 configurations manufacturing cost is reduced by using less material and decreasing defects.

The liners or inserts of the present invention could be inserted into any child resistant container such as the containers 100, 200 described above. The containers 100, 200 as well as the liners could take on different sizes and shapes so long as the liners could be secured within the container. In the alternative, the liners or inserts could be used separately if child resistance is not required.

Each of the embodiments could be modified and constructed to be leak-proof. For example, the liner lid walls could be offset inwardly and the liner box walls could include a channel or indent partially extending through the thickness of the liner box walls so that the liner lid walls and liner box channel or indent engage to form a two-sided seal when in a closed configuration.

Each outer container described above is constructed of hard plastic and manufactured by injection molding to provide sufficient strength and to withstand wear and tear. Each liner described above is also constructed of plastic by injection molding. Silicone could be used to provide a soft, non-stick surface but other plastics could be used as well.

Although this invention has been described in its exemplary forms with a certain degree of particularity, it is understood that the present disclosure has been made only by way of example and numerous changes in the details of construction and combination and arrangement of parts may be employed without departing from the spirit and scope of the invention.

The invention claimed is:

1. A safety container comprising a liner removably disposed in a container box, the liner having a liner box coupled to a liner lid by a hinge, the liner box having a liner floor with upwardly extending liner walls, an outer perimeter of the liner box being complementary with an inner perimeter of the container box, the liner lid being coupled to at least one of the upwardly extending liner walls, wherein in a first closed state the liner lid is positioned such that the liner lid engages the liner walls and in a first open state the liner lid is pivotable away from the liner walls;

the container box having a floor with a plurality of inner container walls extending upwardly therefrom, the container lid having a top plate with a plurality of outer container walls extending downwardly therefrom, wherein the container box is slidingly coupled to the container lid such that in a second closed state the container box is enclosed by the container lid and in a second open state the container box is at least partially removed from the container lid.

2. The safety container of claim 1, wherein the liner is constructed of plastic material.

3. The safety container of claim 2, wherein the plastic material is silicone.

4. The safety container of claim 1, wherein the liner lid is coupled to the at least one upwardly extending liner wall at the hinge which has a bias to cause the liner lid to be normally open in a rested state.

5. The safety container of claim 4, wherein the hinge is reinforced with a plastic material.

6. The safety container of claim 5, wherein the plastic material is silicone.

7. The safety container of claim 1, wherein the liner is positioned within the container box such that in the second closed state the liner is in the first closed state and enclosed within the container box and container lid, and in the second open state the liner is in the first open state.

8. The safety container of claim 7, wherein in the first open state the liner lid is pivoted away from the liner walls to a position at least parallel to the liner floor.

9. A safety container comprising a liner removably disposed within an outer container, the outer container comprising a drawer slidingly coupled to a cover, the drawer having a bottom member with a plurality of inner walls extending upwardly therefrom, the cover having a top member with a plurality of outer walls extending downwardly therefrom, wherein the drawer is slidingly coupled to the cover;

the liner having a liner box removably coupled to a liner lid, the liner box having a liner floor with upwardly extending lower liner walls, an outer perimeter of the liner box being complementary with an inner perimeter of the drawer, the liner lid being coupled to at least one of the upwardly extending lower liner walls, wherein the liner is positioned within the drawer such that the lower liner walls engage the drawer inner walls;

wherein in a closed state the liner lid engages the lower liner walls and the outer container cover encloses the outer container drawer;

wherein in an open state the outer container cover is at least partially removed from the outer container drawer and the liner lid is removable from the liner box lower liner walls.

10. The safety container of claim 9, wherein the liner box is hingedly coupled to the liner lid.

11. The safety container of claim 10, wherein a continuous channel is formed along an upper end of the lower liner walls and a continuous projection extends from the liner lid underside, the channel and projection matching such that the projection is secured within the channel when engaged.

12. A safety container comprising:

a container box; and a liner disposed in the container box, the liner having a liner box coupled to a liner lid by a hinge, the liner box having a liner floor with liner walls, the liner lid being coupled to at least one of the liner walls, wherein in a first closed state the liner lid is positioned such that the liner lid engages the liner walls and in a first open state the liner lid is pivotable away from the liner walls; and wherein the liner lid is coupled to the at least one liner wall at the hinge which has a bias to cause the liner lid to be normally open in a rested state.

13. The safety container of claim 12, wherein the liner is constructed of plastic material.

14. The safety container of claim 13, wherein the plastic material is silicone.

15. The safety container of claim 12, wherein the hinge is reinforced with a plastic material.

16. The safety container of claim 15, wherein the plastic material is silicone.

17. The safety container of claim 12, wherein the container box is slidingly coupled to a container lid, the container box having a floor with a plurality of inner container walls extending upwardly therefrom, the container lid having a top plate with a plurality of outer container walls extending downwardly therefrom, wherein the container box is slidingly coupled to the container lid such that in a second closed state the container box is enclosed by the container lid and in a second open state the container box is at least partially removed from the container lid.

18. The safety container of claim 17, wherein the liner is positioned within the container box such that in the second closed state the liner is in the first closed state and enclosed within the container box and container lid, and in the second open state the liner is in the first open state.

19. The safety container of claim 18, wherein in the first open state the liner lid is pivoted away from the liner walls to a position at least parallel to the liner floor.

* * * * *